United States Patent [19]

Berich

[11] 4,307,042

[45] Dec. 22, 1981

[54] TAMPER RESISTANT CARBURETOR LINK-LEVER CONNECTOR

[75] Inventor: John J. Berich, St. Louis, Mo.

[73] Assignee: ACF Industries, Inc., New York, N.Y.

[21] Appl. No.: 201,467

[22] Filed: Oct. 28, 1980

[51] Int. Cl.[3] ..... F02M 19/12

[52] U.S. Cl. ..... 261/52; 403/71; 403/163; 403/282

[58] Field of Search ..... 261/52; 403/282, 163, 403/71, 70, 69

[56] References Cited

U.S. PATENT DOCUMENTS

| | | | |
|---|---|---|---|
| 1,765,651 | 6/1930 | Bryant | 403/282 |
| 1,828,358 | 10/1931 | Chryst | 403/282 |
| 2,215,614 | 9/1940 | Hunt | 261/52 |
| 2,846,241 | 8/1958 | McDonnell et al. | 403/282 |
| 3,807,885 | 4/1974 | Coski | 403/282 |
| 4,189,623 | 2/1980 | Jacobson | 403/163 |
| 4,269,792 | 5/1981 | Winkley | 261/39 B |

FOREIGN PATENT DOCUMENTS

| | | | |
|---|---|---|---|
| 1229387 | 4/1971 | United Kingdom | 403/163 |
| 1323047 | 7/1973 | United Kingdom | 403/282 |

*Primary Examiner*—Tim R. Miles

*Attorney, Agent, or Firm*—J. Joseph Muller

[57] ABSTRACT

A carburetor improvement for connecting a link (R) to a movable carburetor part (L3) so the connection is tamper resistant. A swivel (3) has a longitudinal bore (5) extending substantially therethrough and a transverse bore (7) through which the link extends. A clevis (13) comprises a pin (15) insertable through an opening (O) in the movable part. The pin has a head (17) and the diameter of the pin is equal to the diameter of the longitudinal bore in the swivel for the pin to be inserted into the bore. The end of the pin inserted thereinto has a generally U-shaped opening (19) at its end, the length of the opening being greater than the diameter of the link and the width of the opening being equal thereto. The inner end of the longitudinal bore has a decreasing diameter whereby the sidewalls (21) of the U-shaped portion of the pin are pinched together and press against the body of the link to capture the link in the swivel with sufficient force to prevent adjustment of the link.

8 Claims, 5 Drawing Figures

FIG. 1
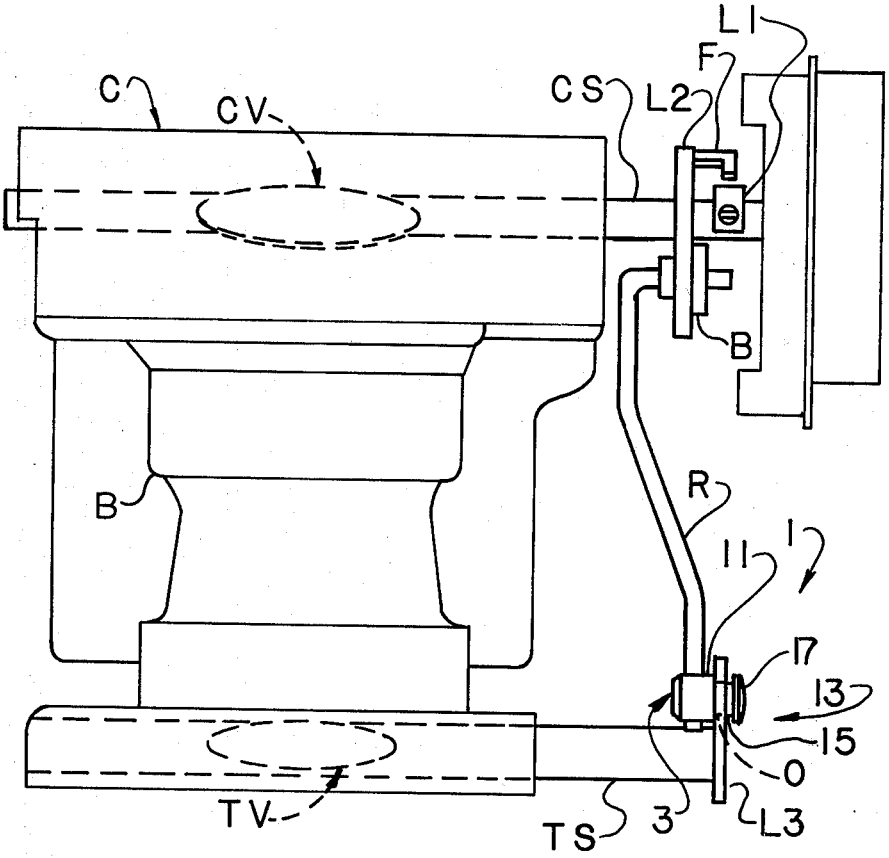
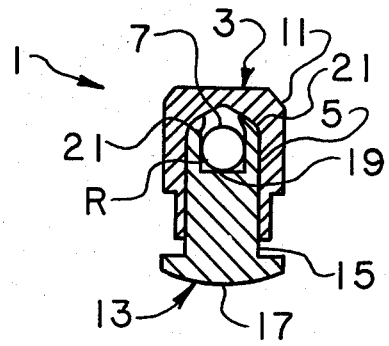
FIG. 4
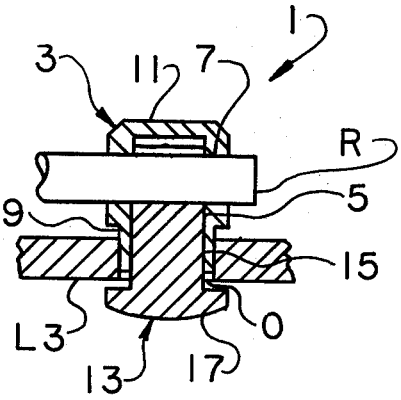
FIG. 5

TAMPER RESISTANT CARBURETOR LINK-LEVER CONNECTOR

BACKGROUND OF THE INVENTION

This invention relates to tamperproofing and, more specifically, to a connector for attaching a carburetor link or the like to a lever or the like so the link cannot later be readjusted.

As a step toward reducing engine emissions, various tamper proofing requirements for automobile carburetors have been promulgated. The purpose of these regulations is to have various carburetor components made tamper resistant so a vehicle owner or mechanic cannot change factory settings after the vehicle is in private hands. One way carburetor adjustments are made is by using adjustable connector rods or links which are attached to, for example, a lever mounted on the side of the carburetor. Previously, an adjustment made in this manner could be changed by bending the link to a different degree than that set at the factory or by changing the connection of the link and lever. Use of a hardened link effectively prevents later bending of the link to a new angle; however, it has still been possible to alter the connection between link and lever.

SUMMARY OF THE INVENTION

Among the objects of the present invention may be noted the provision of tamper resistant means for connecting a carburetor link to a carburetor lever or the like, the provision of such tamper resistant means by which later adjustment of carburetor operation is inhibited, and the provision of such means by which a link is quickly and easily connected to a lever during assembly of the carburetor but by which the link cannot be readily disconnected therefrom thereafter.

Briefly, the improvement of the present invention comprises tamper resistant means for connecting a link on a carburetor to a movable part of the carburetor such as a lever or the like. The tamper resistant means includes rotary means having a longitudinal bore extending substantially therethrough and a transverse bore through which the link extends. The longitudinal bore and transverse bore intersect each other. A clevis comprises a pin insertable through an opening in the movable part, the pin having a head larger in diameter than the size of the opening. The diameter of the pin is equal to the diameter of the longitudinal bore in the rotary means for the pin to be inserted into the bore. The end of the pin inserted thereinto has a generally U-shaped opening at its end. The length of this opening is greater than the diameter of the link and the width of the opening is equal thereto. The inner end of the longitudinal bore has a decreasing diameter whereby the sidewalls of the U-shaped portion of the pin are pinched together and press against the body of the link to capture the link in the rotary means with sufficient force to prevent adjustment of the link. Other objects and features will be in part apparent and in part pointed out hereinafter.

BRIEF DESCRIPTION OF THE DRAWINGS

FIG. 1 is an elevational view of a carburetor illustrating the improvement of the present invention for connecting a link and a lever;

FIG. 4 is a bottom plan view, in section, of the improvement of the present invention; and FIG. 5 is a side elevational view, in section, of the improvement of the present invention.

Corresponding reference characters indicate corresponding parts throughout the several views of the drawings.

DESCRIPTION OF A PREFERRED EMBODIMENT

Figure 2:
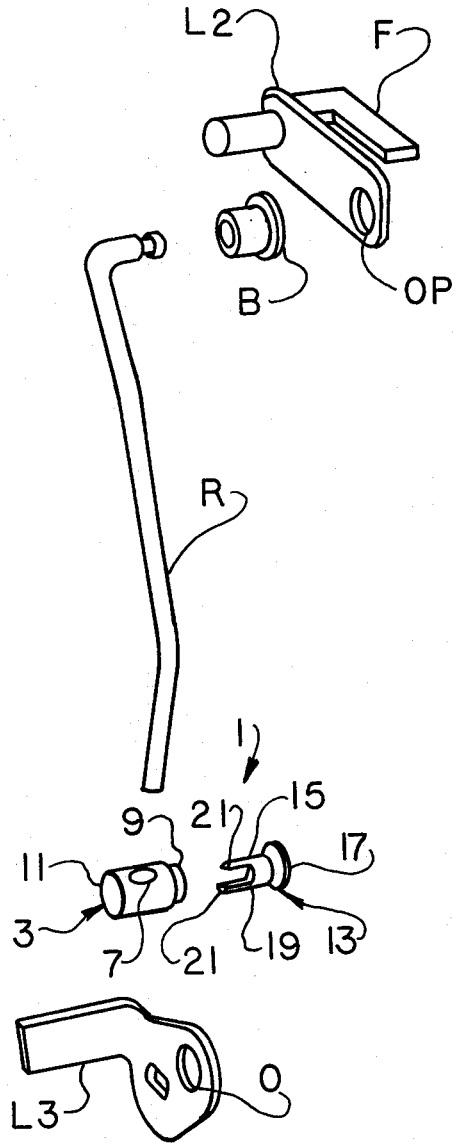
FIG. 2 is an exploded view illustrating the elements comprising the present invention and the carburetor components with which they are used.
Figure 3:
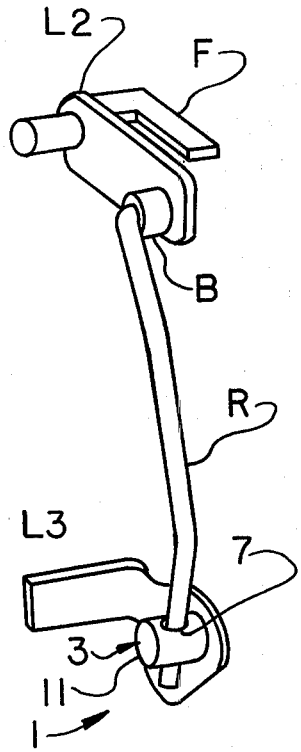
FIG. 3 illustrates the components shown in FIG. 2 in assembled form.

Referring to the drawings, a carburetor C for an internal combustion engine E is shown generally in outline form in FIG. 1. The carburetor has a choke valve CV mounted on a rotatable shaft CS and a throttle valve TV mounted on a throttle shaft TS. The carburetor has various movable parts such as levers which are used to operate the choke valve and throttle valve. For example, a first lever L1 is attached to the outer end of choke shaft CS. A second lever L2 is pivotally attached to the body B of carburetor C. This second lever has a finger F which bears against lever L1 when lever L2 is rotated in the proper direction thus to produce rotation of lever L1. A throttle lever L3 is attached to the outer end of throttle shaft CS and a connecting link or rod R interconnects the one movable part (throttle lever L3) with the other movable part (lever L2).

In operation, the above described mechanism is used to unload choke valve CV when throttle valve TV is fully opened during a normal engine warmup period. That is, when throttle shaft TS rotates the throttle valve open, throttle lever L3 rotates with the shaft. Link R transmits this movement to lever L2 causing a consequent rotation of lever L2 in the direction to bring finger F to bear on lever L1. The finger pushes lever L1 in the direction to rotate choke shaft CS in the direction to open choke valve CV. The point of throttle valve opening at which unloading begins is determined by connecting link R. In the past, during qualification of carburetor C, link R was bent so lever L2 was not moved into contact with lever L1 until throttle valve TV had opened a predetermined amount. Now, link R is a hardened metal and qualification is made by adjusting the length of the link between levers L2 and L3. If link R were connected to lever L3 in a conventional manner, it would be possible for someone to alter the length of link between the levers and thus change the degree of throttle valve opening at which the choke valve is unloaded. Because the factory or qualification setting is, in part, determined by auto emission requirements and fuel economy, any post-qualification modification adversely effects both exhaust emissions and fuel economy.

The improvement of the present invention comprises tamper resistant means 1 for connecting link R to one of the movable parts of carburetor C such as the throttle lever L3 in the present example. Means 1 includes a rotary means 3 commonly referred to as a swivel. The swivel has both a longitudinal bore 5 and an intersecting transverse bore 7. The diameter of bore 7 is such that link R is accomodated therein and when assembled, the link extends through the transverse bore. Further, the swivel has a first cylindrical section 9, the diameter of which is such that section 9 fits in an opening O in lever L3. The swivel has a second and larger diameter section 11, the diameter of this section being larger than that of the opening. Bore 5 extends through section 9 of the swivel and partly through section 11 thereof, while bore 7 extends transversely through swivel section 11.

Means 1 further includes a clevis means or clevis 13 comprising a pin 15 insertable through opening O in lever L3. Pin 15 has a head 17 larger in diameter than the diameter of opening O and the diameter of the pin is equal to that of longitudinal bore 5 thus for the shaft of the pin to be received in the bore. The end of pin 15 inserted into bore 5 has a generally U-shaped opening 19 (see FIGS. 2 and 4). The length of this opening is greater than the diameter of link R and width of the opening is equal to the diameter thereof. Thus, as pin 15 is inserted into bore 5, the end of the pin fits about the portion of link R extending through the transverse bore of the swivel at the intersection of the bores. As shown in FIG. 4, the inner end of longitudinal bore 5 has a decreasing diameter and this causes the sidewalls or arms 21 of the U-shaped portion of pin 15 to pinch together and press against the body of link R. This serves to capture the link in swivel 3 with sufficient force being exerted on the link that it cannot be moved in either direction from its captured position. This prevents adjustment of the link after adjustment of the link after qualification of the carburetor during manufacture.

Swivel 3 and clevis 13 are of either plastic or metal construction. During assembly of carburetor C, one end of link R is inserted through an opening OP in lever L2 and held in position by a bushing B. The other end of the link is inserted through bore 7 in swivel 3 with the appropriate length of link R between levers L2 and L3 being determined during carburetor qualification. With this determined, clevis 13 is inserted into bore 5 and forced into place. Link R is now captured in the swivel and held there with sufficient force that its position cannot be changed. The swivel/clevis assembly cannot now be unmade without so damaging the parts that they cannot be reused.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a carburetor for an internal combustion engine, the carburetor having a link interconnecting a movable part of the carburetor such as a lever or the like with another movable part thereof, the improvement comprising tamper resistant means for connecting the link to one of the movable parts, the tamper resistant means including rotary means having a longitudinal bore extending substantially therethrough and a transverse bore through which the link extends, the longitudinal bore and the transverse bore intersecting each other and clevis means comprising a pin insertable through an opening in the movable part, the pin having a head larger in diameter than the diameter of the opening, the diameter of the pin being substantially equal to the diameter of the longitudinal bore in the rotary means for the pin to be inserted into the bore, the end of the pin inserted thereinto having a generally U-shaped opening at its end, the length of the opening being greater than the diameter of the link and the width of the opening being substantially equal thereto, and the inner end of the longitudinal bore in the rotary means having a decreasing diameter whereby the sidewalls of the U-shaped portion of the pin are pinched together and press against the body of the link to capture the link in the rotary means with sufficient force to prevent adjustment of the link.

2. The improvement as set forth in claim 1 wherein the rotary means comprises a swivel.

3. The improvement as set forth in claim 2 wherein the swivel has a first cylindrical section the diameter of which is such that the section fits into the opening in the movable part and a second and larger diameter cylindrical section in which the transverse bore is formed, the longitudinal bore extending through the first section and into the second section.

4. The improvement as set forth in claim 1 wherein the rotary means and clevis means are made of metal.

5. The improvement as set forth in claim 1 wherein the rotary means and clevis means are made of a plastic material.

6. In a carburetor for an internal combustion engine, the carburetor having a choke valve mounted on a choke shaft, a first lever attached to one end of the choke shaft, a second lever pivotally attached to the carburetor and bearing against the first lever when rotated in the proper direction to produce rotation of the first lever, a throttle lever and a link interconnecting the throttle lever and the second lever, the improvement comprising tamper resistant means for connecting the link to the throttle lever, the tamper resistant means including rotary means having a longitudinal bore extending substantially therethrough and a transverse bore through which the link extends, the longitudinal bore and the transverse bore intersecting each other, and clevis means comprising a pin insertable through an opening in the throttle lever, the pin having a head larger in diameter than the diameter of the opening, the diameter of the pin being substantially equal to the diameter of the longitudinal bore in the rotary means for the pin to be inserted into the bore, the end of the pin inserted thereinto having a generally U-shaped opening at its end, the length of the opening being greater than the diameter of the link and the width of the opening being substantially equal thereto, and the inner end of the longitudinal bore having a decreasing diameter whereby the sidewalls of the U-shaped portion of the pin are pinched together and press against the body of the link to capture the link in the rotary means with sufficient force to prevent adjustment of the link.

7. The improvement as set forth in claim 6 wherein the rotary means comprises a swivel.

8. The improvement as set forth in claim 7 wherein the swivel has a first cylindrical section the diameter of which is such that the section fits into the opening in the throttle lever and a second and larger diameter cylindrical section in which the transverse bore is formed, the longitudinal bore extending through the first section and into the second section.

* * * * *